US010681947B2

(12) United States Patent
Martin

(10) Patent No.: US 10,681,947 B2
(45) Date of Patent: Jun. 16, 2020

(54) GARMENT BUTTON WITH SLIDABLE TRACK FOR TIGHTENING AND LOOSENING OF A GARMENT

(71) Applicant: Eric Lee Martin, Los Angeles, CA (US)

(72) Inventor: Eric Lee Martin, Los Angeles, CA (US)

(73) Assignee: Eric Lee Martin, Los Angeles, CA (US)

( * ) Notice: Subject to any disclaimer, the term of this patent is extended or adjusted under 35 U.S.C. 154(b) by 65 days.

(21) Appl. No.: 15/925,461

(22) Filed: Mar. 19, 2018

(65) Prior Publication Data

US 2018/0263322 A1 Sep. 20, 2018

Related U.S. Application Data

(60) Provisional application No. 62/473,969, filed on Mar. 20, 2017.

(51) Int. Cl.

| | |
|---|---|
| ***A41F 1/00*** | (2006.01) |
| ***A41D 1/06*** | (2006.01) |
| ***A44B 1/18*** | (2006.01) |
| ***A44B 19/24*** | (2006.01) |

(52) U.S. Cl.

CPC ..... *A41F 1/008* (2013.01); *A41D 1/06* (2013.01); *A44B 1/18* (2013.01); *A44B 19/24* (2013.01); *A41D 2300/30* (2013.01)

(58) Field of Classification Search

CPC . A41D 2300/30; A41F 1/008; Y10T 24/2142; Y10T 24/2187

See application file for complete search history.

(56) References Cited

U.S. PATENT DOCUMENTS

| | | | | |
|---|---|---|---|---|
| 1,965,315 | A | 7/1934 | Mainzer | |
| 4,916,779 | A * | 4/1990 | Terada | A41F 1/008 24/171 |
| 4,976,017 | A | 12/1990 | Frano | |
| 2005/0102802 | A1 | 5/2005 | Sitbon et al. | |
| 2010/0011542 | A1* | 1/2010 | Badrenas Buscart | A44B 11/266 24/163 R |
| 2014/0304892 | A1 | 10/2014 | Schneider | |
| 2015/0014463 | A1 | 1/2015 | Converse et al. | |
| 2015/0272249 | A1 | 10/2015 | Glenn | |
| 2015/0289600 | A1* | 10/2015 | Shirai | A44B 11/24 24/303 |

(Continued)

FOREIGN PATENT DOCUMENTS

KR 101573617 B1 12/2015

*Primary Examiner* — Khoa D Huynh
*Assistant Examiner* — Erick I Lopez
(74) *Attorney, Agent, or Firm* — Plager Schack LLP

(57) ABSTRACT

A device for adjusting the fit of a garment may include a track having a plurality of track teeth; and a button including a shoe designed to removably engage with the track; a spring operatively engaged with the shoe; and a plurality of button teeth operatively attached to the spring. When the spring is not compressed, the plurality of button teeth may be designed to removably engage with the plurality of track teeth, and when the spring is compressed, the plurality of button teeth may be designed to disengage from the plurality of track teeth. The device may be attached to the waistband of a garment, resulting in a garment with an adjustable sized waist.

4 Claims, 5 Drawing Sheets

(56) References Cited

U.S. PATENT DOCUMENTS

| | | | | |
|---|---|---|---|---|
| 2016/0015136 | A1* | 1/2016 | Yue | A44C 5/2071 63/1.11 |
| 2017/0006949 | A1 | 1/2017 | Lacy et al. | |

* cited by examiner

GARMENT BUTTON WITH SLIDABLE TRACK FOR TIGHTENING AND LOOSENING OF A GARMENT

RELATED APPLICATION

This application claims priority to provisional patent application U.S. Ser. No. 62/473,969 filed on Mar. 20, 2017, the entire contents of which is herein incorporated by reference.

BACKGROUND

The embodiments herein relate generally to clothing, and more particularly, to a button slidably engaged with a track for adjusting the size of a garment.

Conventional buttons are designed to engage with a buttonhole. Thus, unless there are multiple buttonhole options, a conventional button only provides the ability to have clothing fit at one sizing. Unfortunately, many individuals do not perfectly fit a predefined size. For example, if a male is buying pants and has a size 35 waist, a 34 may be too tight and a 36 may be too big. As a result, he is required to choose a pair of pants that does not fit him quite correctly. Moreover, a user's waist size may vary over the course of a day, week, month, or year. However, conventional clothing does not include adjustable fasteners to provide for adjustments, such as fine tune adjustments, to the clothing Therefore, what is needed is a fastener that allows for customization or adjustment of sizes, wherein the fastener comprises a button designed to slide along a track and removably lock into a desired location on the track to create adjustable sizing of the garment.

SUMMARY

Some embodiments of the present disclosure include a device for adjusting the fit of a garment. The device may include a track having a plurality of track teeth; and a button including a shoe designed to removably engage with the track; a spring operatively engaged with the shoe; and a plurality of button teeth operatively attached to the spring. When the spring is not compressed, the plurality of button teeth may be designed to removably engage with the plurality of track teeth, and when the spring is compressed, the plurality of button teeth may be designed to disengage from the plurality of track teeth. The device may be attached to the waistband of a garment, resulting in a garment with an adjustable sized waist.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a garment fastener providing for adjustable sizes and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

a. Button b. Track

The various elements of the device of the present disclosure may be related in the following exemplary fashion. It is not intended to limit the scope or nature of the relationships between the various elements and the following examples are presented as illustrative examples only.

Figure 1:
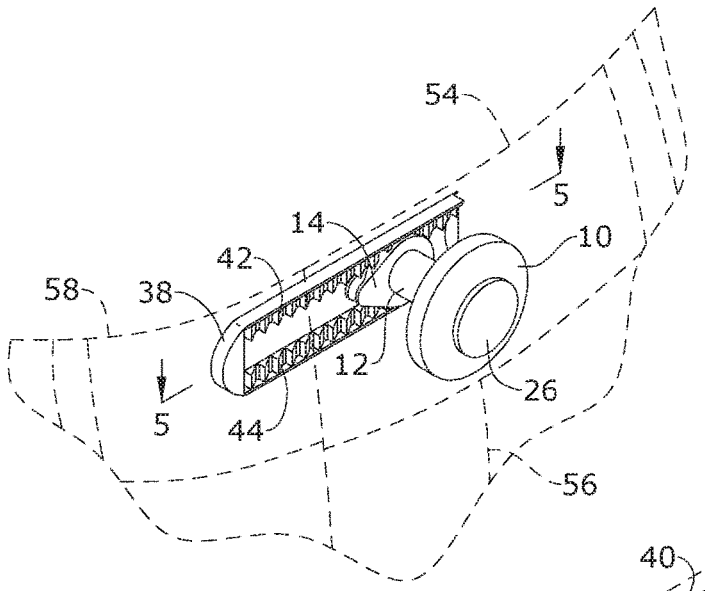
FIG. 1 is a perspective view of one embodiment of the present disclosure.
Figure 2:
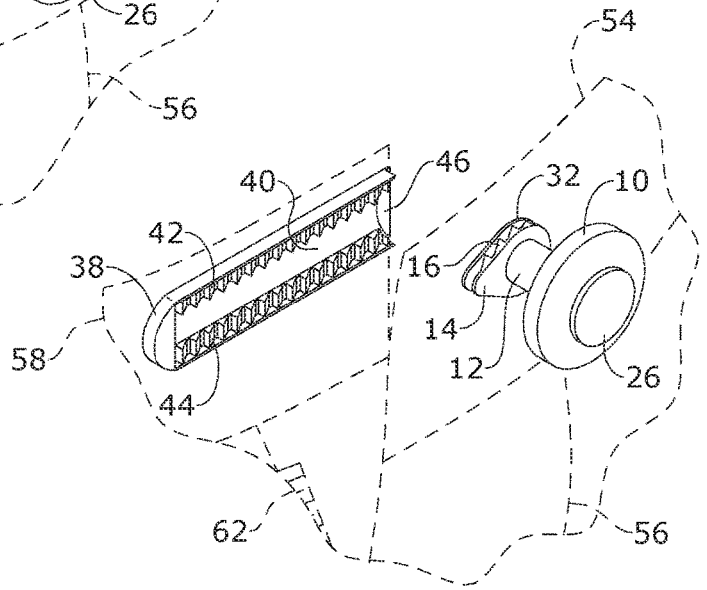
FIG. 2 is a perspective view of one embodiment of the present disclosure.
Figure 3:
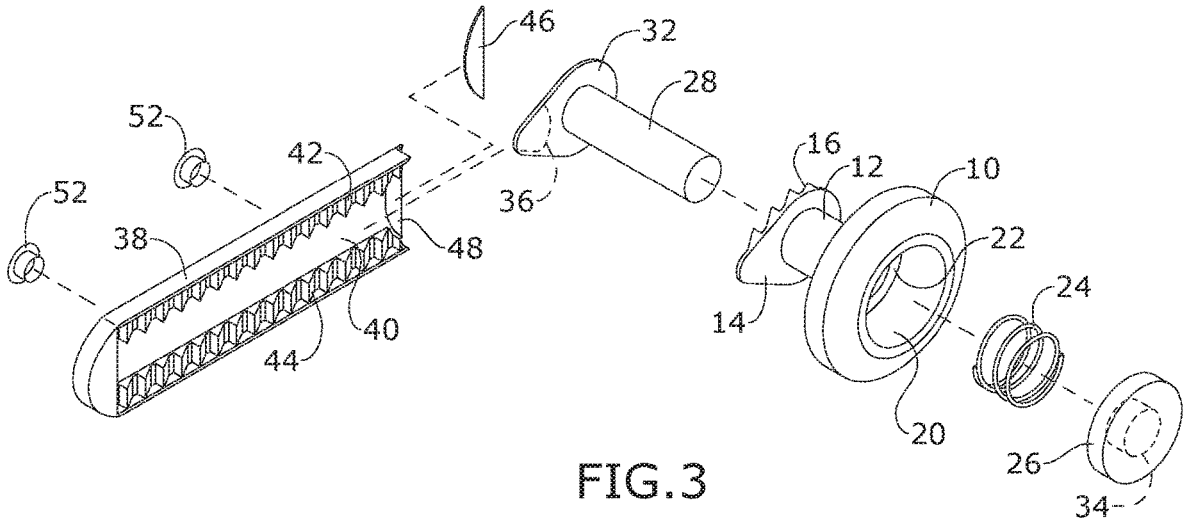
FIG. 3 is a front exploded view of one embodiment of the present disclosure.
Figure 4:
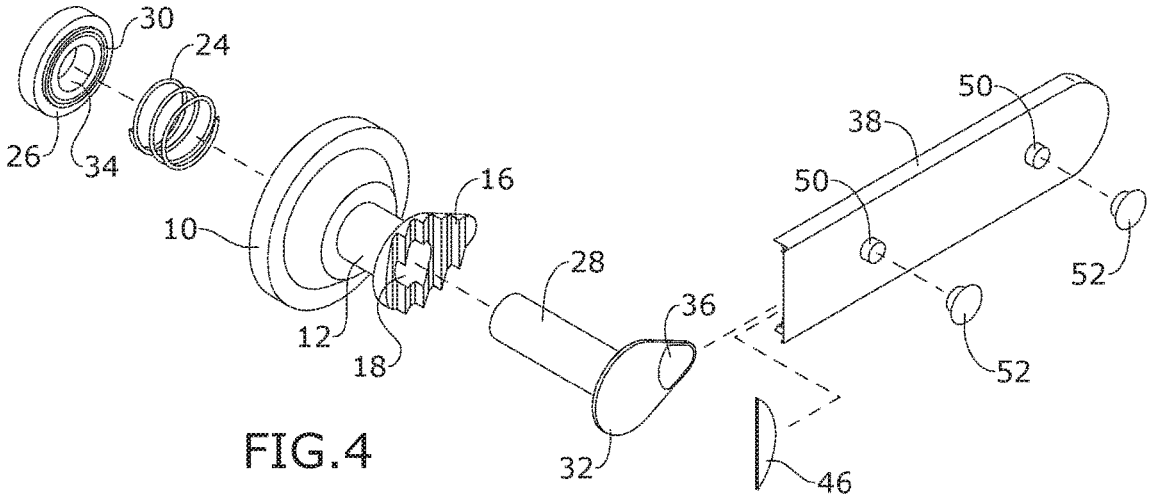
FIG. 4 is a rear exploded view of one embodiment of the present disclosure.
Figure 5:
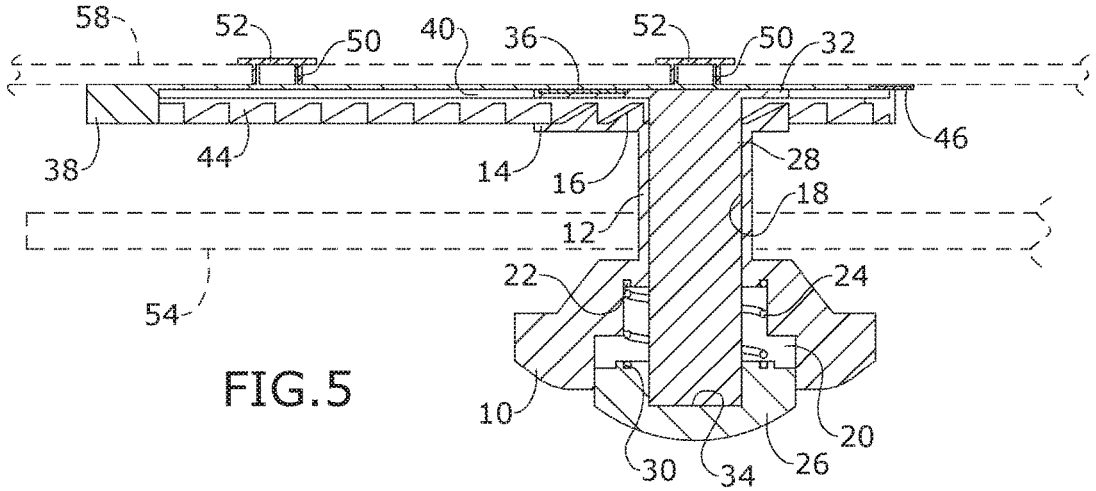
FIG. 5 is a section view of one embodiment of the present disclosure, taken along line 5-5 in FIG. 1.
Figure 7:
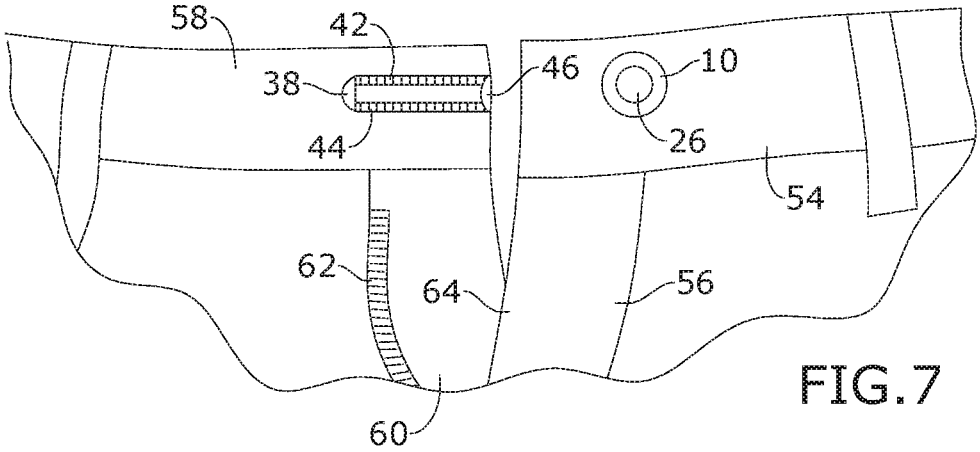
FIG. 7 is a front view of one embodiment of the present disclosure.
Figure 8:
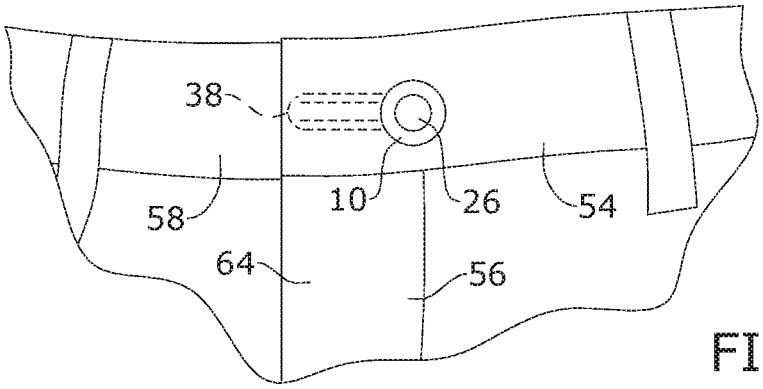
FIG. 8 is a front view of one embodiment of the present disclosure.
Figure 9:
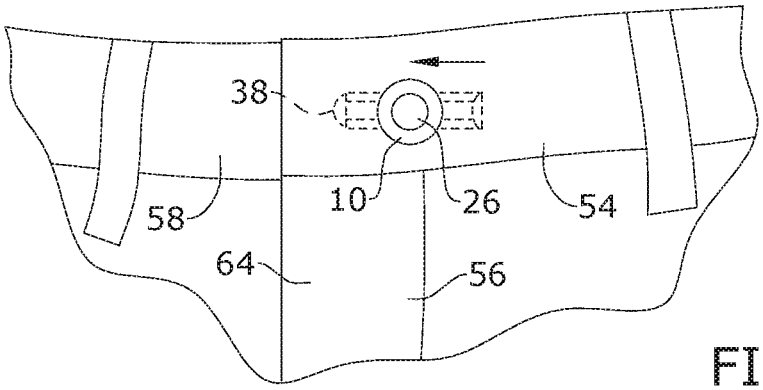
FIG. 9 is a front view of one embodiment of the present disclosure.
Figure 10:
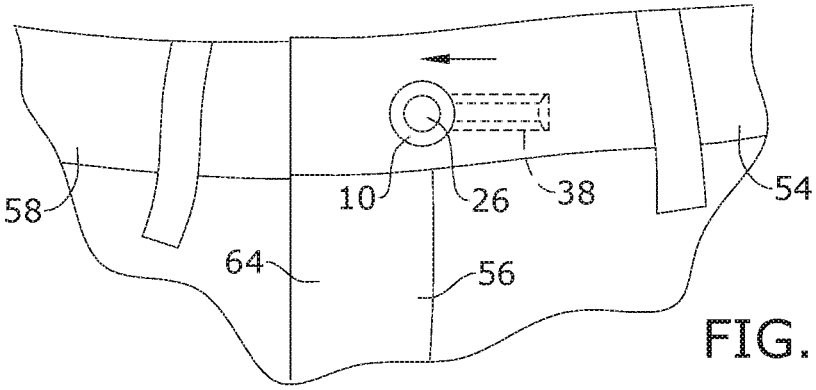
FIG. 10 is a front view of one embodiment of the present disclosure.
Figure 11:
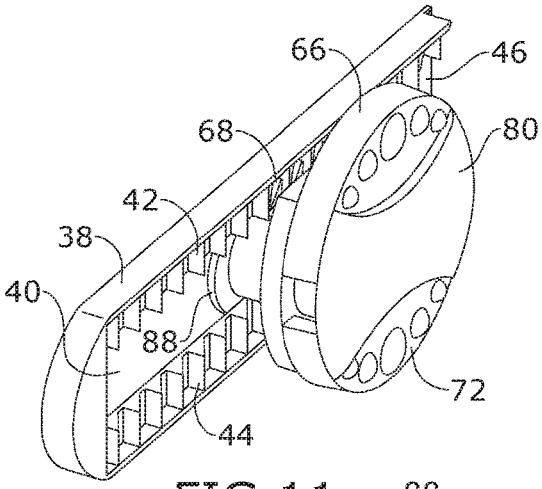
FIG. 11 is a perspective view of one embodiment of the present disclosure.

By way of example, and referring to FIGS. 1-17, some embodiments of the present disclosure include a device for adjusting the fit of a garment, the device comprising a track 38, and a button designed to slide along the track 38 and removably lock into place at any position along a length of the track 38. As shown in FIGS. 1, 2, and 7-10, the device may be incorporated into a garment, such as a pair of pants, wherein the device may replace a conventional button and allow for the garment to have an adjustable fit. Specifically, the track 38 may be attached to the rear waistband 38 using, for example, cap posts 50 that extend from a rear surface of the track 38 and through the rear waistband 38 and garment caps 52 engaged with the cap posts 50. The button may include a post that extends through the front waistband 54 such that a button head is visible to the user and a button shoe designed to engage with the track 38 is on the opposite side of the front waistband 38, as shown in FIG. 5. In embodiments, the garment, such as pants, may include a rear fly 60 with a zipper 62. However, the zipper 62 may be spaced from the waistband to allow for the track 38 and button. Additionally, the front fly 56 designed to cover the track 38 and zipper 62 may include excess fabric 64 such that the track 38 and zipper 62 are covered by the front fly 56 regardless of the button's position on the track, as shown in FIGS. 8-10. The zipper 62 may stop shy of the waistband, such that it stays zipped during any track 38 button movement or action.

The button and the track 38 may each have any suitable structure that allows the button to slide along the length of the track 38 and removably lock into place at the desired location along the track 38.

For example and as shown in FIGS. 1-10, a first embodiment of the button may include a button head 10, a button post 12 extending from the button head, and a button shoe 14 attached to an end of the button post 12 distal from the button head 10. A surface of the button shoe 14 distal from the button head 10 may have a plurality of button shoe teeth 16 extending therefrom, wherein the button shoe teeth 16 are designed and positioned to engage with track teeth on the track 38 (described in more detail below). A button trigger slot 18 may extend through the button head 10, the button post 12, and the button shoe 14, wherein the button trigger slot 18 may be sized to accommodate a trigger post 28 therein. An end of the trigger post 28 proximate to the button head 10 may be engaged with or attached to a trigger head 26, wherein at least a portion of the trigger head 26 may be positioned within a spring cavity 20 in the button head 10. For example, the trigger post 28 may be sized to engage with a trigger post slot 34 in the trigger head 26. A compressible spring 24 may also be positioned within the spring cavity 20, wherein the spring 24 may be engaged with or attached to both the trigger head 26 and the button head 10. Specifically, as shown in the Figures, the button head 10 may include a button spring capture slot 22 therein and the trigger head 26 may include a trigger spring capture slot 30 therein, wherein the spring 24 is held in place within the spring cavity 20 by being engaged with the button spring capture slot 22 and the trigger spring capture slot 30. An end of the trigger post 28 proximate to the button shoe 16 may have a lower shoe 32 attached thereto, wherein the lower shoe 32 is sized to engage with a lower shoe slot 40 in the track 38. The lower shoe 32 may mimic the shape of the button shoe 14.

Optionally, the lower shoe 32 may include a shoe magnet 36 incorporated therein, wherein the shoe magnet 36 is positioned to engage with a track magnet 46 incorporated within the track 38. For example, the track magnet 46 may be positioned within a track magnet slot 48 on the track 38.

Figure 6:
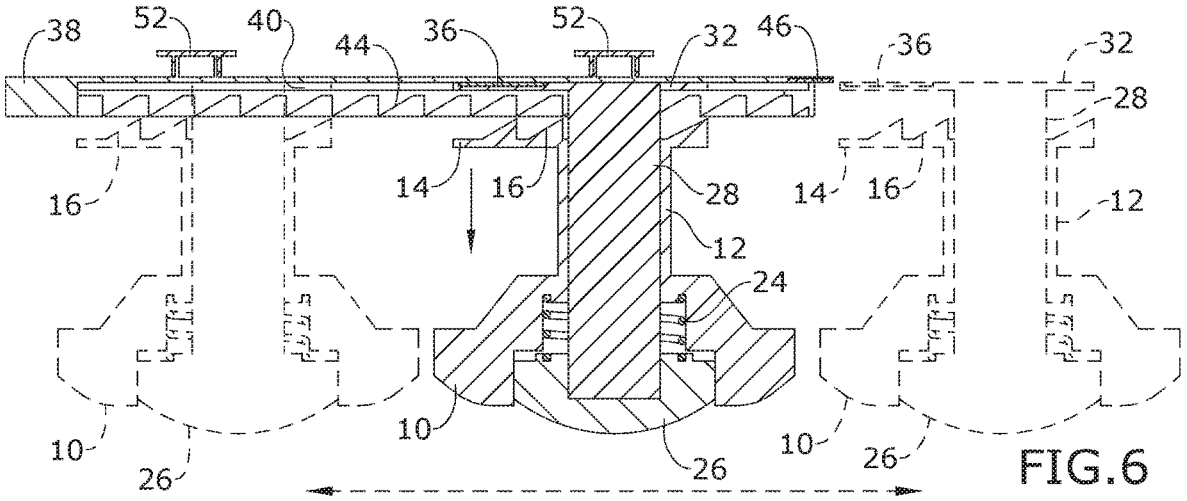
FIG. 6 is a section view of one embodiment of the present disclosure.

As a result of the structure of the button in this first embodiment and as shown in FIGS. 5 and 6, when the trigger head 26 is pressed, the spring 24 is compressed and the trigger post 28 and lower shoe 32 put pressure on the track 38, causing the button shoe 14 to disengage with the track 38, allowing the button to slide freely along a length of the track 38. When the trigger head 26 is released, the button shoe 14 again engages with the track 38.

Figure 12:
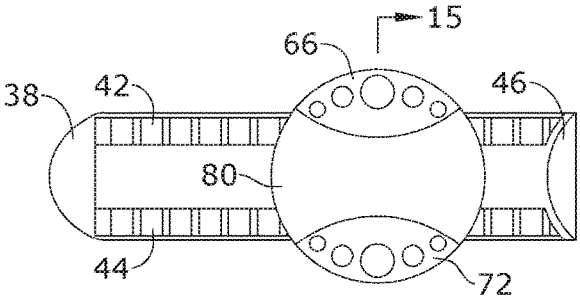
FIG. 12 is a front view of one embodiment of the present disclosure.
Figure 13:
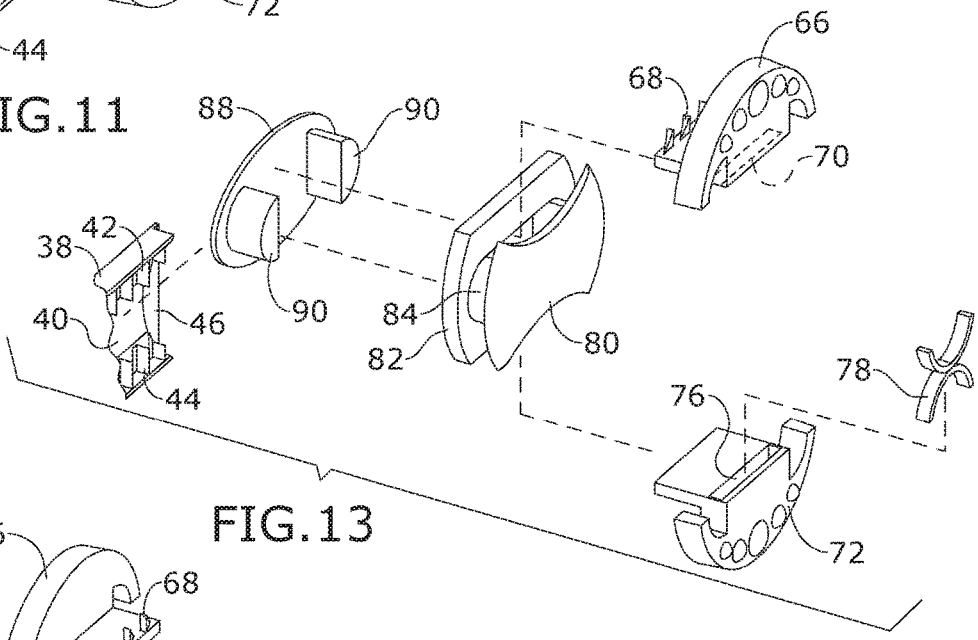
FIG. 13 is a front exploded view of one embodiment of the present disclosure.
Figure 14:
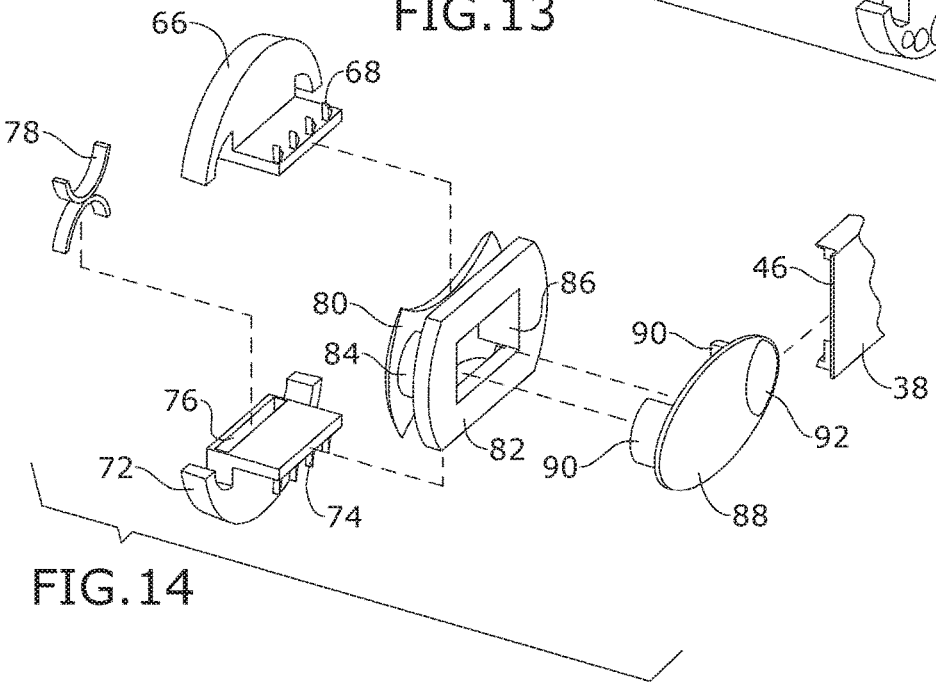
FIG. 14 is a rear exploded view of one embodiment of the present disclosure.
Figure 15:
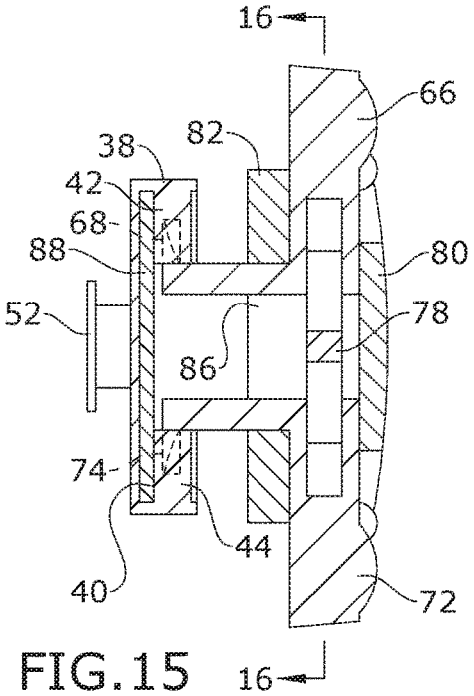
FIG. 15 is a section view of one embodiment of the present disclosure, taken along line 15-15 in FIG. 12.
Figure 16:
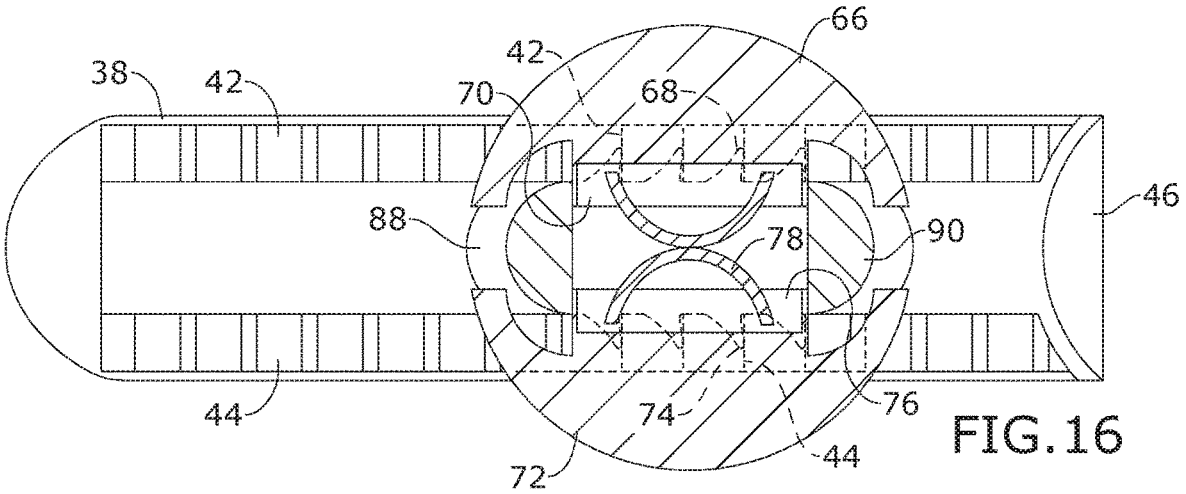
FIG. 16 is a section view of one embodiment of the present disclosure, taken along line 16-16 in FIG. 15.
Figure 17:
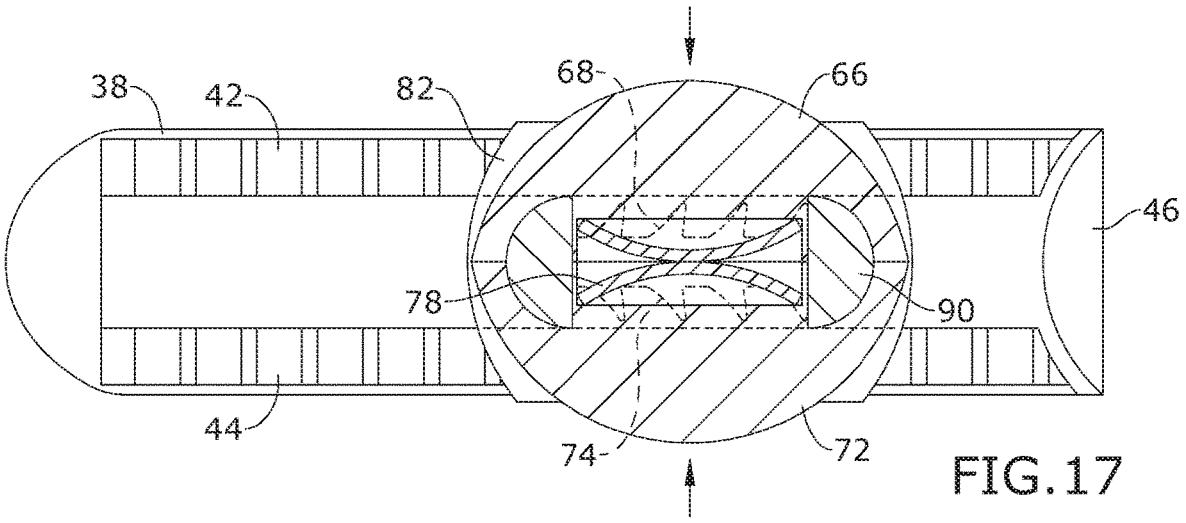
FIG. 17 is a section view of one embodiment of the present disclosure.

As shown in FIGS. 11-17, a second embodiment of the button may comprise a base shoe 88 designed to engage with the track 38. The base shoe 88 may be operatively attached to a pair of triggers, such as an upper trigger 66 and a lower trigger 72, wherein a spring 78 is positioned between the upper trigger 66 and the lower trigger 72. For example, a first half of the spring 78 may be positioned within a lower trigger spring slot 76, and a second half of the spring 78 may be positioned within an upper trigger spring slot 70. The spring 78 may be designed to push the triggers 66, 72 away from one another. Each of the triggers 66, 72 may have a plurality of teeth attached thereto, the teeth being designed to engage with teeth on the track 38 (describe in more detail below). For example, the upper trigger 66 may comprise upper trigger teeth 68 designed to engage with upper track teeth 42, and the lower trigger 72 may comprise lower trigger teeth 74 designed to engage with lower track teeth 44. A housing comprising a front housing 80 and a rear housing 82 attached to one another by housing posts 84 may be designed to cover a central portion of the button, such that the inner edge of the upper trigger 66, the inner edge of the lower trigger 72, and the spring 78 are not visible from an exterior of the button, as shown in FIG. 12. The housing may also include a rear housing slot 86 extending through the rear housing 82, wherein the base shoe 88 engages with the housing via the engagement or insertion of the base posts 90 into the rear housing slot 86.

Optionally, the base shoe 88 may include a base magnet 92 incorporated therein, wherein the base magnet 92 is positioned to engage with a track magnet 46 incorporated within a shoe slot in the track 38.

As a result of the structure of the button in the second embodiment, when the triggers 66, 72 are pressed together, the trigger teeth 68, 74 are drawn inward, thus disengaging the trigger teeth 68, 74 from the teeth on the track 38 and allowing the button to slide along the track. When the triggers 68, 74 are released, the spring 78 pushes the triggers 68, 74 outward, causing the trigger teeth 68, 74 to engage with the teeth on the track 38.

In embodiments, the track 38 may comprise an elongate track having a plurality of teeth positioned along the length of the track 38, wherein, as described above, the button comprises a shoe with teeth designed to engage with the plurality of teeth on the track 38 to lock the button into place. Specifically, the track 38 may comprise a recessed shoe slot 40 sized to accommodate the button's shoe and two rows of teeth (i.e., upper track teeth 42 and lower track teeth 44) positioned proximate to a top edge and a bottom edge of the recessed shoe slot 40. Alternatively, while not shown in the drawings, it is also envisioned that the track 38 may comprise a monorail that the button may straddle and slide along, wherein the sides of the monorail may comprise track teeth configured to engage with teeth on the button's shoe. The track 38 may optionally include a track magnet 46 incorporated therein such that, if the shoe includes a shoe magnet, the track magnet 46 and shoe magnet are attracted to one another to increase the ease at which the button engages with the track 38.

At least one end of the track 38, such as the end of the track 38 closest to the inner edge of the rear waistband 58 when the device is incorporated into a pair of pants, may be open to allow the insertion of the button's shoe therein. As such, the button and the track 38 may be completely disengaged, as shown in FIG. 7, for removal of the garment or article of clothing.

Both the track teeth and button teeth may have a saw tooth structure, which may enable the button to move in a single direction into and along the track 38 for tightening sizes without the need to compress the trigger(s). Alternatively, instead of the track and button having teeth, the device may comprise a pin and hole system, wherein the button includes a pin that is operatively attached to the spring/trigger and the track comprises a plurality of pin holes. When the button is slid onto the track, the pin is designed to engage with one of the holes in the track. To disengage the pin, the triggers/springs would be compressed.

The device of the present disclosure may be made of any suitable or desired materials and may be available in various sizes, which may be dependent on the intended use of the device. The device may be incorporated into any garment, article of clothing, or item, such as pants, a skirt, a belt, a blouse, a jacket, any other garment, shoes, a bag, or the like that would benefit from an adjustable fit or sizing. As used herein, the term "pants" may refer to any garment designed to be worn on the lower half of a user's body, wherein the garment is secured to user's waist via a waistband.

To use the device of the present disclosure, the track 38 and the button may be sewn or otherwise attached to the desired garment. To engage the device, the button may be simply slid into and along the track 38. Once the button is at the desired location along the length of the track 38 and because of the structure of the button, it may automatically lock into place. To loosen the fit or unfasten the button from the track, the user may simply press the trigger head 26 or pinch the triggers 66, 72 to disengage the teeth on the button from the teeth on the track 38 and slide the button off of the track 38.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A device for adjusting the fit of a garment, the device comprising:

a track comprising:

an elongate shoe slot; and a plurality of track teeth comprising a plurality of upper track teeth positioned proximate to an upper edge of the elongate shoe slot and a plurality of lower track teeth positioned proximate to a lower edge of the elongate shoe slot; and a button comprising:

a shoe designed to removably engage with the track;

a spring operatively engaged with the shoe; and a plurality of button teeth operatively attached to the spring;

a button head with a spring cavity;

a button post extending from the button head;

a button shoe attached to an end of the button post distal from the button head;

a button trigger slot extending through the button head, the button post, and the button shoe;

a trigger post positioned within the button trigger slot;

a trigger head engaged with an end of the trigger post proximate to the button head; and a lower shoe attached to an end of the trigger post proximate to the button shoe, the lower shoe sized to fit within the elongate shoe slot, wherein the lower shoe is the shoe designed to removably engage with the track, wherein:

when the spring is not compressed, the plurality of button teeth are designed to removably engage with the plurality of track teeth; and when the spring is compressed, the plurality of button teeth are designed to disengage from the plurality of track teeth.

2. The device of claim 1 wherein a surface of the button shoe distal from the button head comprises the plurality of button teeth extending therefrom.

3. The device of claim 1, wherein:

the track further comprises a track magnet incorporated therein; and the button further comprises a button magnet incorporated therein, the button magnet positioned to engage with the track magnet when the shoe is removably engaged with the track.

4. A garment with an adjustable sized waistband, the garment comprising:

a rear waistband;

a front waistband;

a track attached to the rear waistband, the track comprising an elongate shoe slot and a plurality of track teeth comprising a plurality of upper track teeth positioned proximate to an upper edge of the elongate shoe slot and a plurality of lower track teeth positioned proximate to a lower edge of the elongate shoe slot; and a button attached to the front waist band, the button comprising:

a button head with a spring cavity;

a button post extending from the button head;

a button shoe attached to an end of the button post distal from the button head;

a button trigger slot extending through the button head, the button post, and the button shoe;

a trigger post positioned within the button trigger slot;

a trigger head engaged with an end of the trigger post proximate to the button head;

a lower shoe attached to an end of the trigger post proximate to the button shoe, the lower shoe sized to fit within the elongate shoe slot, wherein the lower shoe is designed to removably engage with the track;

a spring operatively engaged with the lower shoe; and a plurality of button teeth operatively attached to the spring, wherein:

when the spring is not compressed, the plurality of button teeth are designed to removably engage with the plurality of track teeth; and when the spring is compressed, the plurality of button teeth are in designed to disengage from the plurality of track teeth.

* * * * *